US008523024B2

(12) United States Patent
Piscopo et al.

(10) Patent No.: US 8,523,024 B2
(45) Date of Patent: Sep. 3, 2013

(54) CAP AND SPOUT COMBO

(75) Inventors: Peter Piscopo, Medford, NJ (US); Alex Szekely, Jackson, NJ (US); Kevin P. Shutack, Neshanic Station, NJ (US); Jason Joseph Nikitczuk, North Brunswick, NJ (US); Richard Chomik, Doylestown, PA (US)

(73) Assignee: Church & Dwight Co., Inc., Princeton, NJ (US)

( * ) Notice: Subject to any disclaimer, the term of this patent is extended or adjusted under 35 U.S.C. 154(b) by 278 days.

(21) Appl. No.: 12/920,770

(22) PCT Filed: Mar. 3, 2009

(86) PCT No.: PCT/US2009/035880

§ 371 (c)(1),
(2), (4) Date: Nov. 18, 2010

(87) PCT Pub. No.: WO2009/111474

PCT Pub. Date: Sep. 11, 2009

(65) Prior Publication Data

US 2011/0204099 A1 Aug. 25, 2011

Related U.S. Application Data

(60) Provisional application No. 61/033,701, filed on Mar. 4, 2008.

(51) Int. Cl.
*B65D 25/40* (2006.01)

(52) U.S. Cl.
USPC ..... 222/568

(58) Field of Classification Search
USPC ..... 222/109, 568, 562, 153.09, 544–545, 222/566; 215/330–333
See application file for complete search history.

(56) References Cited

U.S. PATENT DOCUMENTS

| | | | | | |
|---|---|---|---|---|---|
| 4,099,639 | A | * | 7/1978 | Boxer et al. | 215/209 |
| 4,128,189 | A | | 12/1978 | Baxter | |
| 4,550,862 | A | | 11/1985 | Barker et al. | |
| 4,671,421 | A | | 6/1987 | Reiber et al. | |
| 4,706,829 | A | | 11/1987 | Li | |
| 4,749,103 | A | | 6/1988 | Barriac | |
| 4,799,597 | A | * | 1/1989 | Mayes et al. | 215/250 |
| 4,836,419 | A | * | 6/1989 | Metz et al. | 222/110 |
| 4,890,770 | A | | 1/1990 | Haga et al. | |
| 4,917,269 | A | | 4/1990 | Fuchs et al. | |
| 5,058,772 | A | | 10/1991 | Moore et al. | |
| 5,060,827 | A | | 10/1991 | Segati | |
| 5,108,009 | A | | 4/1992 | Davidson et al. | |
| 5,131,566 | A | | 7/1992 | Bavegems | |

(Continued)

FOREIGN PATENT DOCUMENTS

FR 2631935 A1 12/1989

*Primary Examiner* — Paul R Durand
*Assistant Examiner* — Robert Nichols, II
(74) *Attorney, Agent, or Firm* — Frenkel & Associates, P.C.; Allen R. Kipnes; Stephen B. Shear

(57) ABSTRACT

The present invention is directed to a novel cap and spout closure which provides for spout orientation, sealing, and locking when applied to a container or bottle. The present invention provides for a unique lug and notch assembly, which properly aligns and locks the cap and spout closure onto a container or bottle. The pre-assembled cap of the present invention is useful as a cap and spout for liquid laundry detergent.

19 Claims, 5 Drawing Sheets

(56) References Cited

U.S. PATENT DOCUMENTS

| | | | | |
|---|---|---|---|---|
| 5,150,804 | A * | 9/1992 | Blanchet et al. | 220/212 |
| 5,238,152 | A * | 8/1993 | Maas et al. | 222/153.09 |
| 5,251,788 | A | 10/1993 | Moore | |
| 5,431,306 | A | 7/1995 | Reid | |
| 5,435,467 | A | 7/1995 | Ekkert et al. | |
| 5,462,202 | A | 10/1995 | Haffner et al. | |
| 5,941,422 | A | 8/1999 | Struble | |
| 6,398,076 | B1 | 6/2002 | Giblin et al. | |
| 6,848,484 | B1 | 2/2005 | Darr | |
| 6,923,341 | B2 * | 8/2005 | Smith | 222/109 |
| 6,964,359 | B1 | 11/2005 | Darr et al. | |
| 7,393,342 | B2 * | 7/2008 | Henniges et al. | 604/187 |
| 2001/0013478 | A1 * | 8/2001 | Earnhart | 206/407 |
| 2006/0131330 | A1 | 6/2006 | Stebick et al. | |
| 2007/0051691 | A1 | 3/2007 | Hidding | |
| 2007/0194047 | A1 | 8/2007 | Tauber et al. | |
| 2008/0142547 | A1 * | 6/2008 | Colacioppo et al. | 222/109 |
| 2008/0164282 | A1 | 7/2008 | Szekely et al. | |
| 2009/0045224 | A1 * | 2/2009 | Faaborg et al. | 222/111 |
| 2009/0101682 | A1 | 4/2009 | Szekely et al. | |
| 2009/0223962 | A1 | 9/2009 | Szekely | |
| 2010/0043910 | A1 | 2/2010 | Szekely et al. | |
| 2010/0116776 | A1 | 5/2010 | Szekely | |

* cited by examiner

CAP AND SPOUT COMBO

FIELD OF THE INVENTION

The present invention is directed to a pre-assembled cap and spout which provides for spout orientation, sealing, and locking when applied to a container. Moreover, the pre-assembled cap of the present invention is useful as a cap and spout for liquid laundry detergent.

BACKGROUND OF THE INVENTION

Molded thermoplastic containers have found wide application in the packaging of liquid detergents, fabric softeners, and other viscous liquid products. Conventional closures employed in such containers include anti-drip pour spouts and cooperating dosing caps. Typically, a pour spout fitment is fastened within a dispensing opening in the container and enclosed with an overlying cap which can serve as a measuring cup. Flow restrictor and drainage features are provided in the fitment by provision of inclined base members in the fitment which include openings that communicate with the container interior.

Conventional dispenser closures used for pouring the container contents often consist of three components, an inner sleeve which is friction-fit to the inside of the neck of the container, a spout portion which is normally snap-fit into the sleeve so that the spout projects vertically beyond the upper margins of the sleeve and the container neck, and a cap portion which is threaded onto the neck and may often serve as a measuring cup. This type of closure is commonly used for containers of liquid household laundry detergent and related products, although the closure of the invention is not restricted to any specific type of application.

For example, Davidson et al., U.S. Pat. No. 5,108,009 discloses a package having a spout-containing fitment wherein external threads on the package finish cooperate with internal threads on a closure/measuring cup. The Davidson et al. bottle includes a locking circumferential ridge on an inner peripheral surface of the upper end portion of the bottle fitment (see FIGS. 9 and 10), which retains the fitment.

Baxter, U.S. Pat. No. 4,128,189 is directed to a container for viscous fluids having an insert provided with a pouring lip. A cover includes a flange to engage a flange on the fitment when the cover is closed. As seen in FIG. 4, inner aspects of the finish appear to extend inwardly against the fitment and cover. The finish has outwardly extending threads cooperating with inwardly extending threads of a cap.

Bavegems, U.S. Pat. No. 5,131,566 discloses a transition piece having internal threads cooperating with external threads on a container finish. The transition piece includes a spout. The patent mentions that by attaching the transition piece by a screw head, if the user prefers not to use the pouring spout, but prefers to fill it by the free neck opening, this can be done easily by unscrewing the transition piece. The preferred embodiment is said to disclose a refill facilitating pouring spout which is part of a transition piece with inside screw head for fastening to the container cap.

Li, U.S. Pat. No. 4,706,829 discloses a dispensing package including a bottle finish having outwardly extending threads mating with a cap having inwardly extending threads. A pour spout-containing fitment is mounted on the bottle finish.

Moore, U.S. Pat. No. 5,251,788 discloses a closure having interior threads designed to engage exterior threads on a spout body. The spout body includes internal threading which mates with external threading on the container finish.

Ekkert et al., U.S. Pat. No. 5,435,467 is directed to a container having an externally threaded finish which mates with an internally threaded finish of a closure. A fitment having a radially extending flange is inserted within the mouth of the container and the radially extending flange rests upon the top of the finish. The arrangement is such that the amount of residual contents left within the container is said to be diminished. The illustrated spout fitment appears to have substantial areas open for product to flow through, relative to the area defined by the outer spout wall.

Haga et al., U.S. Pat. No. 4,890,770 discloses a package having outer threads mating with inner threads of an adapter which has a pour spout. The adapter has outer threads which mate with inner threads on a closure. The closure includes a flange which rests on a portion of the adapter.

Haffner et al., U.S. Pat. No. 5,462,202 is directed to a liquid dispensing fitment which rests on an upper edge of the container finish. The container finish includes outside extending screws which mate with inwardly extending screws on the closure. The fitment includes a pour spout.

Fuchs et al., U.S. Pat. No. 4,917,269 discloses a package having a neck comprising an upwardly extending integral dispensing spout. Internal threads on the container finish cooperate with external threads on the closure. The closure also includes an annular flexible sealing ring and a second sealing ring.

Moore et al., U.S. Pat. No. 5,058,772 discloses a dispensing package including a finish having outer threads which mate with inner threads on a spout fitment. The spout fitment also has outer threads which mate with inner threads on a closure.

Reiber et al., U.S. Pat. No. 4,671,421 discloses a plastic blow molded container having an annular finish and an insert positioned in the finish and interengaged with the internal surface of the finish. The insert has internal threads for receiving a closure which may be in the form of a self draining measuring cup having external threads on the lower end thereof and a peripheral flange sealingly engaging the free end of the finish. In one form, the insert is placed in position while the finish is hot, and when the finish cools it shrinks into sealing engagement with the finish. In another form, the insert is spin welded into sealing engagement with the finish. Alternatively, an adhesive may be used.

U.S. Pat. No. 4,550,862 shows a liquid product pouring and measuring package having a measuring cup which also serves as the closure for the package. The package includes a container including a container body with an upwardly extending finish and a dispensing orifice. A transition collar is mounted on the container finish and has a pouring spout and a circumscribing wall with fastening means on its interior surface. A measuring cup serves as a closure for the package and includes outwardly disposed fastening means adapted to mate with the inwardly facing fastening means on the transition collar to attach the measuring cup in the inverted position to the transition collar and thereby provide a closure for the package.

Locking teeth can be provided on the inner periphery of the transition collar to mate with locking teeth on the container finish so that the transition collar, when mounted on the container finish, will not rotate. However, a more secure engagement between the transition collar and the container finish can be provided by a glued engagement. The glued engagement provides a firm and rigid interlocking between the container finish and transition collar.

However, it would be desirable to provide an improved package including the container and transition collar with firm interlocking between these components. The improved package would include a measuring cup mounted onto the transition collar, wherein for example the resultant interlock between the container and collar will allow the measuring cup to be removed and replaced without causing rotation of the collar. This should desirably be accomplished with a glued, interlocked engagement and with a reasonable cost and with a minimum amount of glue.

It is therefore a principal object of the present invention to provide an improved package for liquids including a container for housing liquids and a transition collar having a pouring spout firmly mounted on the container finish.

It is a further object of the present invention to provide an improved package as aforesaid including a measuring cup mounted on the transition collar, wherein the measuring cup can be removed and replaced without causing rotation of the collar.

Yet another object of the present invention is to provide the correct spout orientation, sealing, and locking when applied to the container.

Further objects and advantages of the present invention will appear hereinbelow.

SUMMARY OF THE INVENTION

The present invention is directed to a dispensing and closing package for a liquid comprising a container or bottle, and a cap and spout closure. Moreover, the invention consists of a cap and notched spout closure designed to mate with a lugged container or bottle neck which allows the spout to be oriented and locked to prevent removal by the customer. In one embodiment, the lugs are located on the parting lines of the bottle, thereby allowing for more plastic to be used in the lug formation, and thus, providing more durable lugs. In another embodiment, the lugs are dovetail shaped, which, when mated to corresponding dovetail shaped notches, create a very strong mechanism to prevent over-torquing during assembly or inadvertent spout removal. In yet another embodiment, the cap and spout closure contains a flexible band spout seal which has been created in such a way that it will prevent product leakage and conform to the top of the bottle, even when the bottle is not perfectly trimmed, or trimmed to differing heights.

The cap and spout of the present invention allows for receipt of empty bottles in a bulk, oriented, palletized format without the cap and spout closure pre-assembled onto the container of bottle. The bottles can be filled prior to installation of the oriented cap and spout and closure.

DETAILED DESCRIPTION OF THE INVENTION

The present invention is directed to a cap and spout closure for a bottle or container. More specifically, the present invention is directed to a cap and spout closure designed to mate with a lugged bottle neck which allows the spout to be properly oriented and locked to the bottle or container to prevent removal by the customer.

Figure 1:
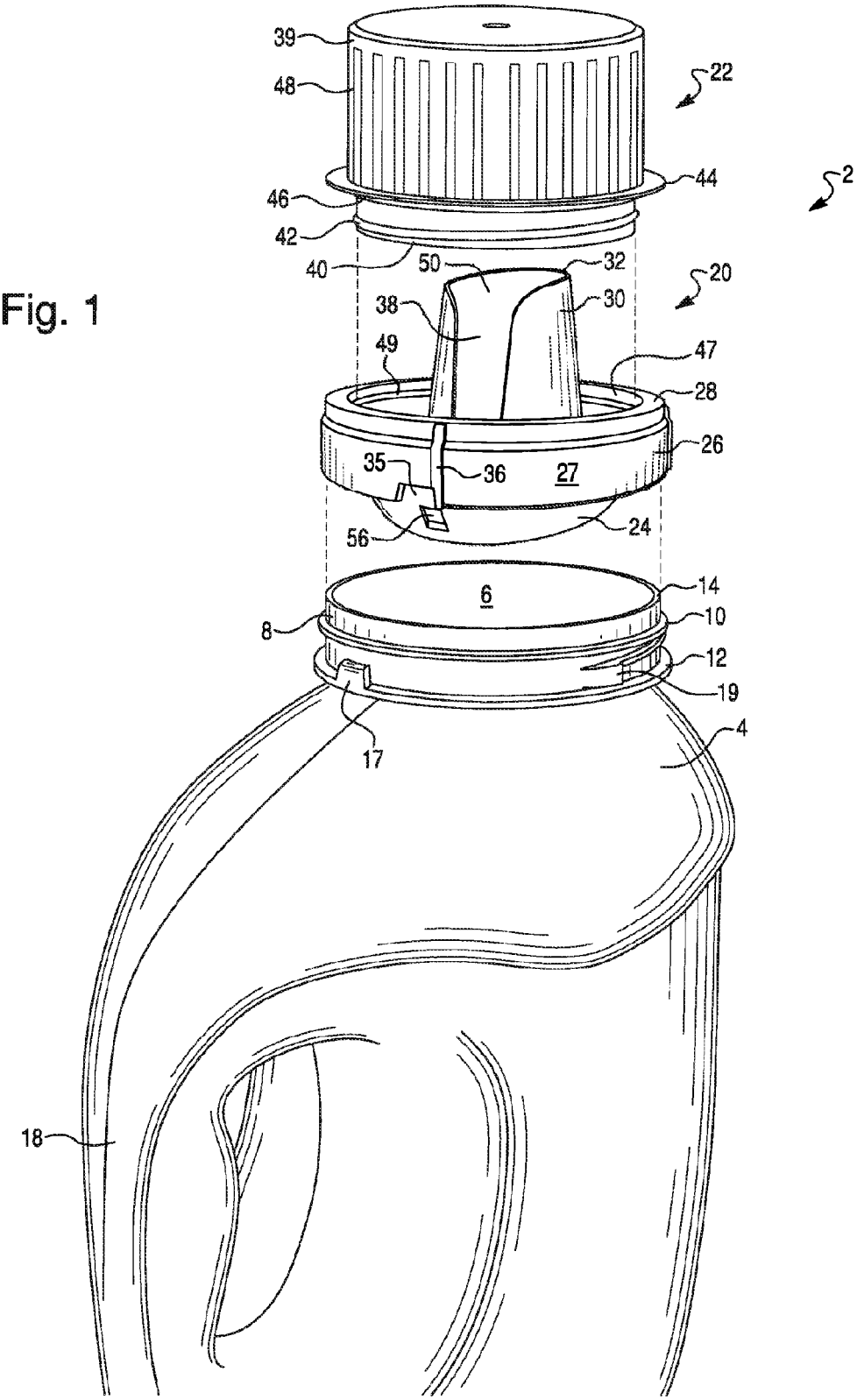
FIG. 1 is an exploded perspective view of the spout and cap closure of the present invention and a corresponding lugged bottle.
Figure 2:
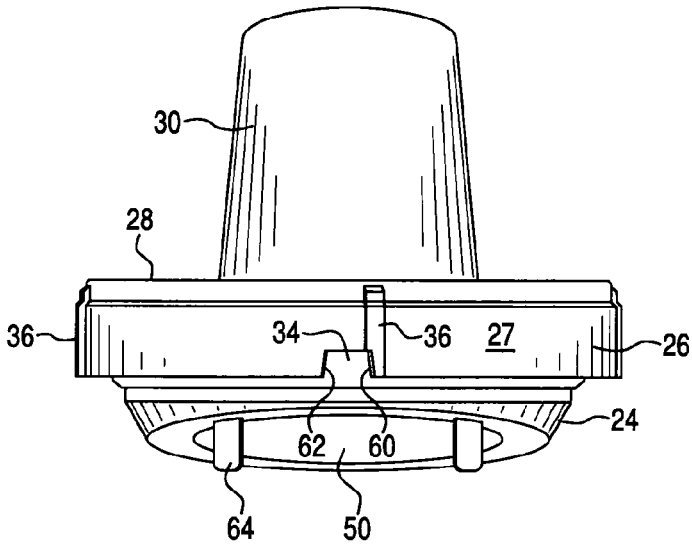
FIG. 2 is a side view of the spout structure of the cap closure of the present invention shown in FIG. 1.
Figure 3:
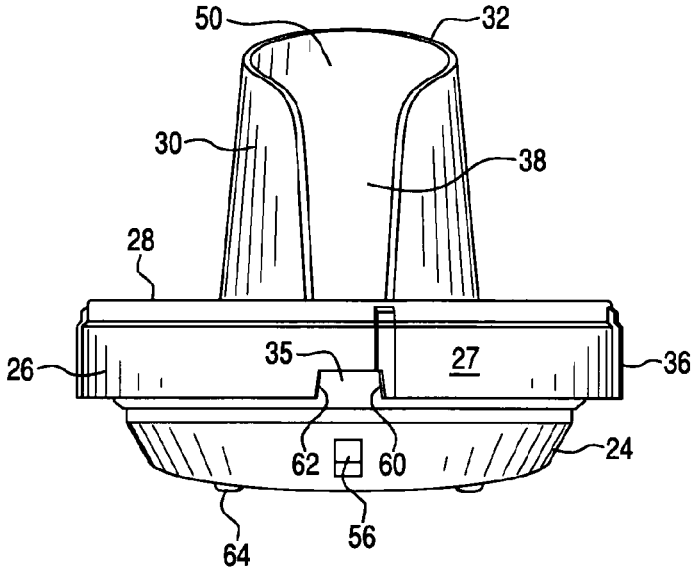
FIG. 3 is a side view of the spout structure of the cap closure of the present invention shown in FIG. 1.

Referring now to FIG. 1, the cap and spout closure of the present invention is generally designated as 2 and is shown exploded from a typical container or bottle 4. The container or bottle 4 includes a neck 8 having threads 10 on an exterior surface thereof and a mouth opening 6 defined by the upper edge 14 of the neck 8. A stop 19 may be located at the base of the threads to prevent over rotating the cap and spout closure during assembly. A radially projecting peripheral shoulder 12 is located at the base of the neck 8 and has at least one, and preferably a plurality of locking lugs 17. In one embodiment, the container or bottle 4 has two locking lugs. In another embodiment, the locking lugs can differ in size, for example, the container or bottle can have two lugs 16 and 17 (see also FIG. 6), wherein one lug is smaller than the second larger lug. The first smaller lug can be from about 4 mm to about 8 mm wide and the second larger lug can be from about 6 mm to about 10 mm wide. The container or bottle 4 will typically include a handle formation 16 to facilitate holding the container or when pouring the contents out from the container. The container or bottle 4 may be manufactured of a suitable polymeric material, but the specific material used depends on the substance which is to be held within the container or bottle 4.

The cap and spout closure 2 in essentially a two-piece closure. The cap and spout closure 2 has a spout structure 20 and a separate cap structure 22. The spout structure 20 and the cap structure 22 may be made of a suitable polymeric material. The spout structure 20 has a lower portion 24, which is dimensioned to be inserted into a the mouth opening 6 of the container or bottle 4, a central body portion 26, which can be used to assemble the spout structure 20 onto the bottle or container 4, and a spout 30 for pouring out or dispensing the contents of the container or bottle 4. The central body 26 has a radial top edge 28 and a depending skirt 27. The skirt 27 is provided with threads on an interior surface (not shown), which are configured to threadably engage the threads 10 on the neck 8 of the container or bottle 4. The skirt 27 may also includes at least one, and preferably a plurality of gripping ribs 36 and at least one, preferably a plurality of notches 35.

The cap structure 22 provides a closure to the spout structure 20 when assembled onto the container or bottle 4. The cap structure 22 has a generally tubular upper section 39, a radially projecting cap shoulder 44 and a generally tubular lower section 40. To enhance the user's grip of the cap structure 22, the upper section 39 may include a plurality of spaced, generally parallel, external gripping ribs 48. The lower section 40 is provided with threads 42 on the exterior surface. The threaded surface of the lower section 40 is configured to threadably engage the threads 49 on a vertical upper wall 47 of an interior portion 45 of the spout structure 20. The radially projecting cap shoulder 44 of the cap structure 22 may include at least one radial seal 46 which provides a more secure seal between the cap structure 22 and the spout structure 20, thereby preventing spillage if the container or bottle 4 is inadvertently overturned. The radial seal 46 is dimensioned to slidingly engage the vertical upper wall 47 of the interior portion 45 of the spout structure 20. As is well known in the art the cap structure 22 can include measuring marks for use as a measuring cup for the contents of the container or bottle 4. When the contents are poured from the cap structure 22, the threads 42, which are located on the exterior surface of the lower section 40 of the cap structure 22 will not be exposed to the container contents.

Referring to FIGS. 1 through 5, a spout 30 is integral with the spout structure 20 and is preferably molded as part of the spout structure 20. The spout 30 and spout structure 20 define an open channel 50, which provides fluid communication with the interior of the container or bottle 4 and is disposed through the length of the spout 30 and the spout structure 20. The spout 30 terminating at an upper edge 32, which is generally oval or circular in shape and may be tapered or frusto-conical shaped to help prevent spillage when pouring the contents. In one embodiment, the body of the spout 30 may include a vertical slit or opening 38, which runs vertically along the body of the spout 30 substantially to a lower floor 52 of the lower portion 24. It is preferred that the upper edge 32 be generally oval in shape to aid in directing the fluid flow of the container contents and to minimize spillage, which may result with other shapes. The spout structure may include a pair of leveling legs 64, which form a tripod with a lower end of the lower floor 52 to maintain the spout structure 20 in an upright position, thus facilitating manipulation by vertically-oriented automatic handling equipment.

The frusto-conical shape for the spout 30 is preferred because it provides for an increased directional flow of the container contents and fluidly cooperates with the generally oval shaped upper edge 32. As shown best in FIG. 1, the spout structure 20 can be non-concentrically oriented within the spout structure 20 so that the spout 30 is directed away from the handle 16 of the container or bottle 4. This orientation of the spout 30 with respect to the spout structure 20, and container or bottle 4, minimizes spillage and increases the control of the fluid stream during pouring. Together, the frusto-conically shaped body of the spout 30 and the generally oval shaped upper edge 32 gives the user more control over the fluid stream of the contents poured from the container or bottle 4. Essentially, the frusto-conical shape allows for a more consistent flow of contents through the open channel 50 because the lower portion 24 can accept a large quantity of the contents, while the spout 30 constricts the flow to create a steady, directional stream of the contents. Further, because the body of the spout 30 contains a vertical slit or opening 38 therein, the spout 30 allows for an even more consistent flow while further minimizing spillage. Lastly, because of the non-concentric orientation of the spout 30 with regards to the lower portion 24, the mouth opening 6 or the container or bottle 4 and the handle 16, the user is further prevented from pouring the contents improperly. This particular arrangement of the spout 30 causes the frusto-conically shaped body of the spout 30 to be directed or disposed away from the handle 16 to increase the pouring angle, the consistency of the fluid stream and the amount of ventilating air that enters the container or bottle 4.

Figure 4:
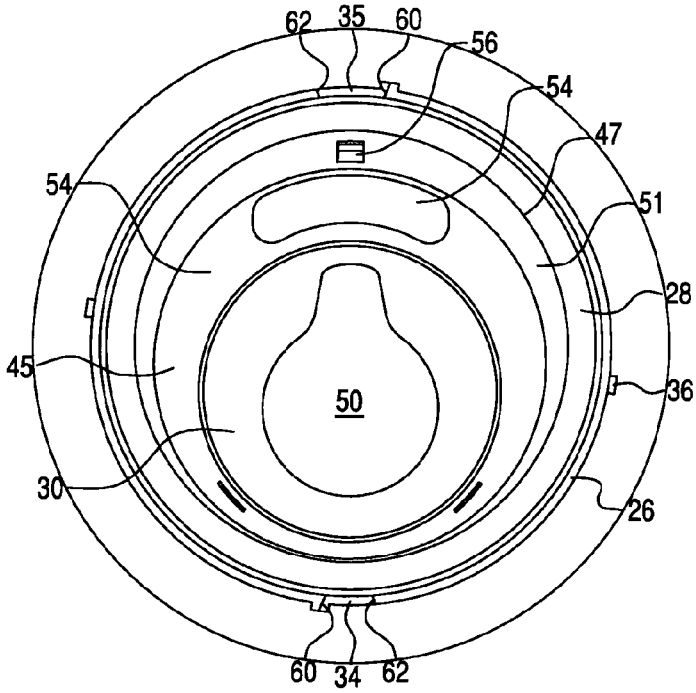
FIG. 4 is a top view of the spout structure of the cap closure of the present invention shown in FIG. 1.
Figure 5:
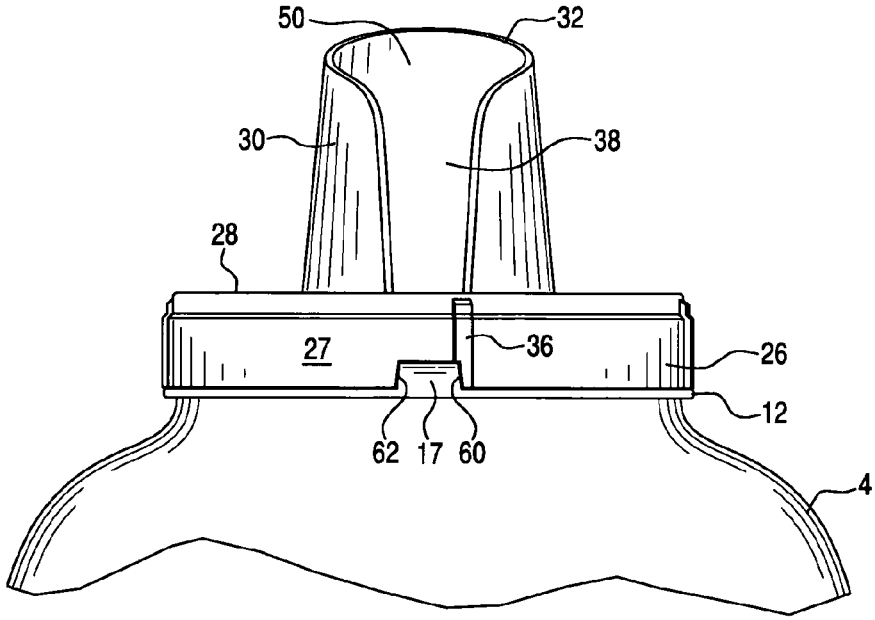
FIG. 5 is a partial side view of the spout structure of the cap closure of the present invention shown in FIG. 1, assembled on a bottle in accordance with the present invention.

Referring now to FIG. 4, the spout structure 20 is shown in greater detail. The central body 26 and the radial top edge 28 define an interior portion 45 consisting of a vertical upper wall 47 containing threads 49 which can threadably engage the threads 42 on the exterior surface 40 of the lower section 40 of the cap structure 22. The interior portion 45 further contains a lower wall 51, which slopes downward terminating at the lower floor 52. In one embodiment, the lower wall 51 may have an air opening 56 therein, which can provide ventilation during pouring of the contents, and thus, provide a more consistent flow.

The lower floor 52 may include therein a drainage formation 54. The lower floor 52 is sloped to enable the drainage of any excess or residual material, from the spout 30 back into the container or bottle 4 once the container resumes its normal vertical post-pouring position. It is preferred that the drainage formation 54 be formed at the lowermost point along the incline of the lower floor 52. Thus, the lowermost point of the lower floor 52 terminates at the drainage formation 54. For this reason, the lower floor 52 actually acts as a gutter or trough to catch liquid draining from the spout and to enable that liquid to flow downward along the lower floor 52 and through the drainage formation 54 into the container or bottle 4.

Spout structure 20 also includes a central body portion 26, which is substantially closed about its axis from the radial top edge 28 to the lower floor 52. The central body portion 26 forms the outer structure of the open channel 50, which provides fluid communication with the interior of the container or bottle 4 and is disposed through the length of the spout 30 and the spout structure 20. Although substantially closed, the central portion 26 includes a drainage formation 54 in the lower floor 52, as previously mentioned. The spout 30 is generally frusto-conical or elongated in shape. The spout 30 is generally disposed in the center of the spout structure 20, or as shown, preferably disposed in a non-concentric orientation or off-centered with respect to the spout structure 20.

It is contemplated that the drainage formation 54 will be substantially rectangular or circular in shape, but other configurations not herein specifically disclosed can be utilized without departing from the principles of the present cap and spout closure 2. As shown most clearly in FIG. 4, the drainage formation 54 is located on the opposite side of the spout structure as the working edge or pouring edge of the spout 30. This particular arrangement of the drainage formation 54 increases the consistency of the flow, in terms of the egress speed and quantity, when the user tilts or inverts the container or bottle 4 to use the product contained therein. The drainage formation 54 accomplishes this by permitting a steady stream of ventilating air to enter the container or bottle 4 when the container or bottle 4 is tilted over or inverted by the user. As the contents of the container or bottle 4 are dispensed, the drainage formation 54 permits ventilating air to enter the container and fill the empty space, thereby causing the contents to be pushed or forced out of the container or bottle 4. As shown, the spout structure 20 can contain a second air opening 56 to allow for additional ventilation. Accordingly, the present drainage formation 54 serves a dual purpose. First, it provides a draining system for the return of unused material back into the container or bottle 4. Secondly, it functions to allow a steady stream of ventilating air into the container or bottle 4 to help force the contents out.

As shown in FIGS. 1 through 8, the cap and spout closure 2 of the present invention provides a unique means for assembling and locking the cap and spout onto a container or bottle 4.

Figure 6:
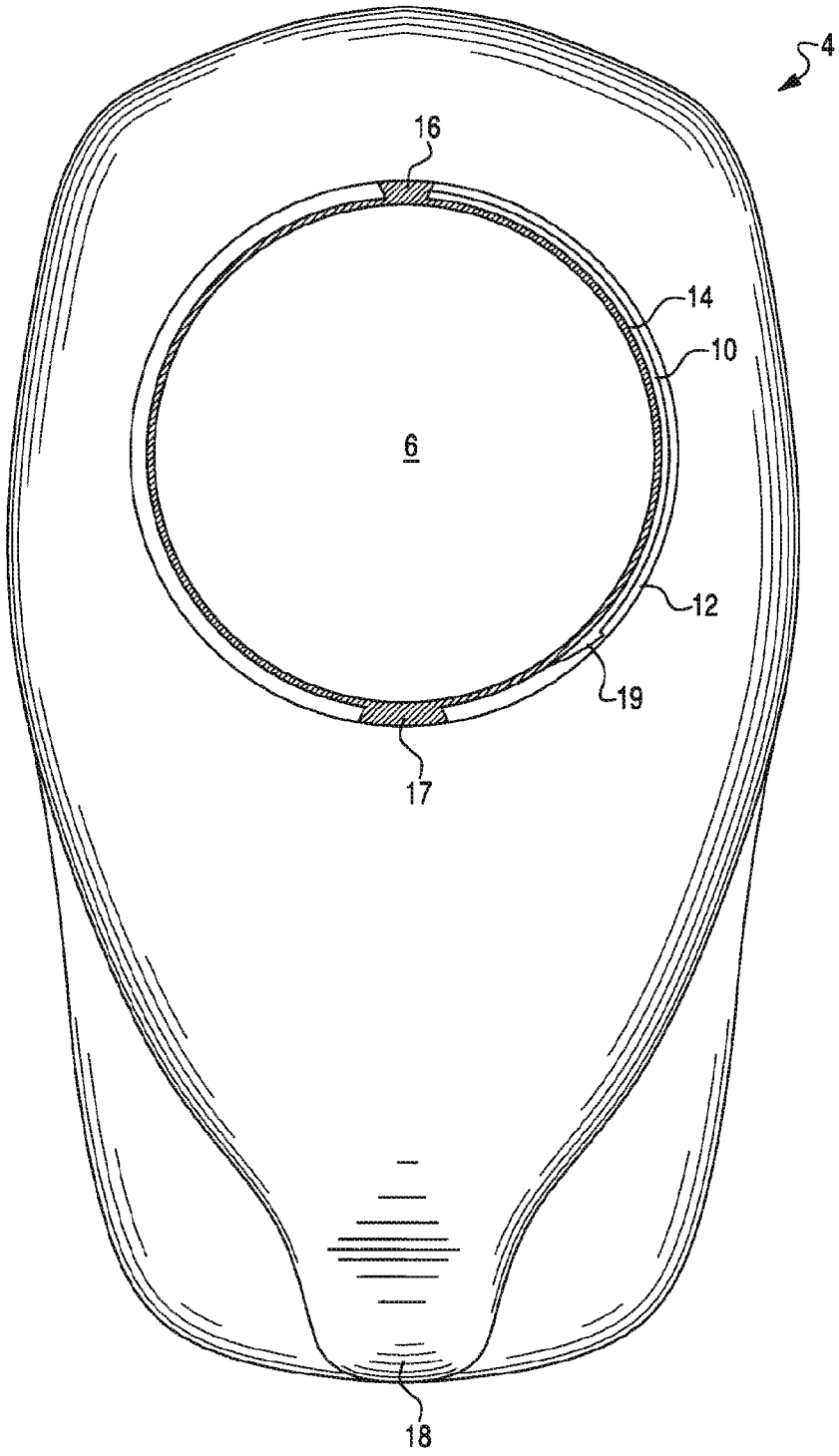
FIG. 6 is a top view of the bottle, in accordance with the present invention.
Figure 7:
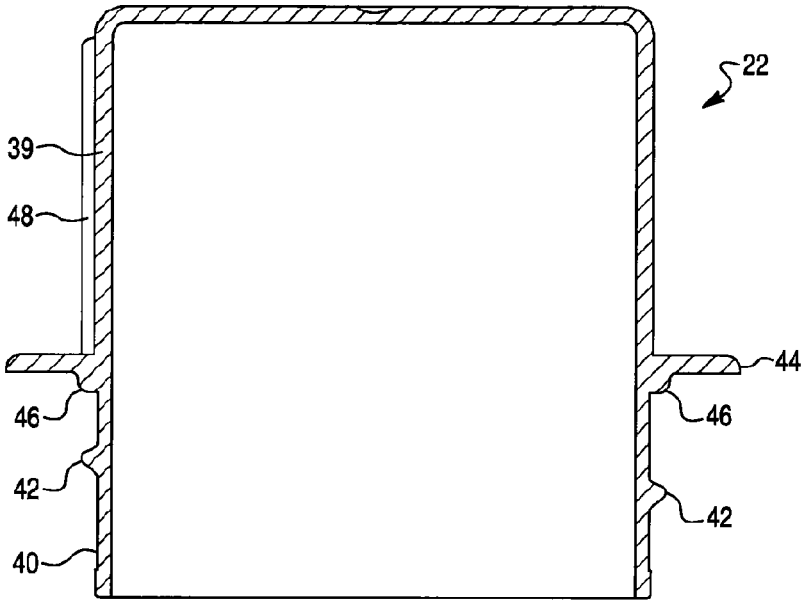
FIG. 7 is a vertical cross-sectional view the cap structure, in accordance with the present invention.

As previously mentioned, the spout structure 20 has corresponding notches 34 and 35 (see, e.g., FIGS. 2 and 3) and the container or bottle 4 has at least one lug, preferably two lugs 16 and 17 (see, e.g., FIG. 6). The lugs 16 and 17 are configured to engage the corresponding notches 34 and 35, respectfully, as the spout structure 20 is threaded upon the neck 8 of the container or bottle 4, locking the spout structure 20 onto the container or bottle 4. Additionally, the lugs 16 and 17, as well as the notches 34 and 35, are both dove-tail shaped thereby further improving the locking means of the present invention. This dove-tail shape provides a greater surface area of contact between the lugs 16 and 17, and the corresponding notches 34 and 35, respectfully, thereby improving the locking mechanism between the spout structure 20 and the container or bottle 4.

As previously mentioned, in one embodiment the lugs 16 and 17, and the corresponding notches 34 and 35, respectfully, can differ in size. Because one lug 16 is smaller than the second larger lug 17, the larger lug will not fit into the smaller notch 34. Moreover, since the notches 16 and 17 have to pass the lugs upon assembly, the last 180 degrees of rotation to properly seat the spout structure 20 onto the container or bottle 4 can cause the most damage to the bottle lugs. Since the lugs 16 and 17 and corresponding notches 34 and 35, respectfully, are different sizes the smaller notch 34 rides past the larger lug 17 for last 180 degrees of rotation avoiding a second and certainly more dramatic hit to the lug while seating in the finished assembled position. This aspect allows the cap and spout closure 2 to be properly orientated onto the neck of the container or bottle 4. This proper orientation occurs when the smaller lug 16 engages the smaller notch 34, and the larger lug 17 engages the corresponding larger notch 35, upon assembly of the cap and spout closure 2 onto the container or bottle 4. As previously mentioned, this engagement of the lugs 16 and 17, and corresponding notches 34 and 35, respectfully, locks the cap and spout closure 2 onto the container or bottle, preventing removal thereof by the consumer.

In another embodiment, the spout structure 20 can contains exterior ribs 36, which can be aligned adjacent to the notches 34 and 35 (as shown in FIGS. 1 through 5), thereby providing a broad working surface or stopping surface 60, which can act as a stop to prevent over-torquing or over rotation of the cap and spout closure 2 when assembling the cap and spout closure 2 onto the container or bottle 4. Although the threads (not shown) of the skirt 27 and the threads 10 of the neck 8 are designed to be of the conventional clockwise or right-hand type, it is also contemplated that these threads may be of the counterclockwise or of the left-hand type.

Figure 8:
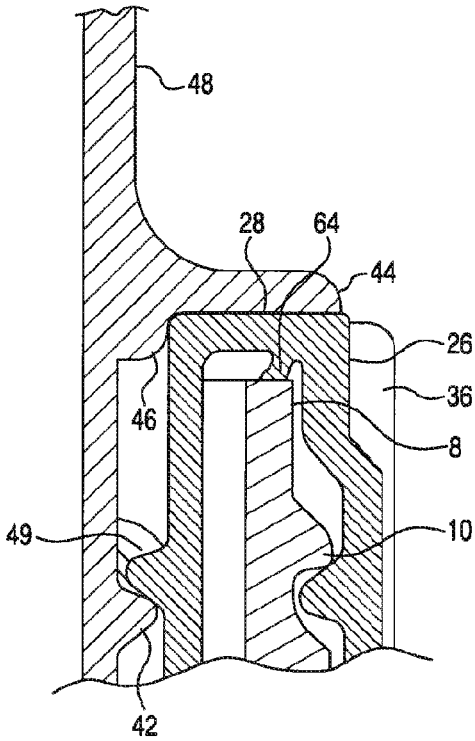
FIG. 8 is a vertical cross-sectional view of the bottle with the cap and spout closure assembled thereon, in accordance with the present invention.

In yet another embodiment of the present invention, the spout structure 20 also includes a flexible band spout seal 64 (as shown in FIG. 8), which provides a more secure seal between the spout structure 20 and the container neck 8. As shown, the flexible band spout seal 64 is located on the under side of a radial top edge 28 of the spout structure 20. The flexible band spout seal 64 will prevent product leakage and will allow the spout structure 20 to conform to the top edge 14 of the container or bottle 4 even when the top edge 14 of the container or bottle 4 is not perfectly trimmed, or trimmed to differing heights.

Assembly of the cap and spout closure 2 onto the container or bottle 4 is simple and efficient. The container or bottle 4 is first filled with the specified contents, normally a liquid. Next, the preassembled, integral cap and spout closure 2 is threaded upon the threaded neck 8 of the container or bottle 4. To assist in threading the cap and spout closure 2 onto the container or bottle 4, the central portion 26 of the spout structure 20 is provided with a plurality of exterior ribs 36 as a means to grip the cap and spout closure 2. The exterior ribs 36 on the spout are aligned with and are coincident with the working edge or stopping edge 60 of the notches 34 and 35 of the spout structure 20. As previously mentioned, the alignment of the ribs 36 with the spout notches 34 and 35 produces a broad wall surface that serves as a stop with the corresponding lugs 16 and 17 on the container or bottle 4. The opposite side of the spout notches 34 and 35 that are not designed as stops are used as anti-removal edges 62, which interface with the opposite side of the lugs 16 and 17 on the container or bottle 4, locking the cap and spout closure 2 in place, thereby preventing removal thereof by the consumer. Also, as previously mentioned, the lugs 16 and 17 of the container or bottle 4, and the corresponding notches 34 and 35, which provide a stopping edge 60 and an anti-removal edge 62, are dove-tail shaped or keystone shaped to provide an interlocking interface between the lugs 16 and 17 and the corresponding notches 34 and 35 of the cap and spout closure 2. The combination of the dove-tailed lugs 16 and 17 and the dove-tail shaped notches 34 and 35, improves the locking mechanism between the cap and spout closure 2 and the container or bottle 4, ensuring that the cap and spout closure will not override past the lugs 16 and 17 upon assembly of the cap and spout closure 2 onto the container or bottle 4.

In the preferred embodiment, during this threading action, lugs 17 and 18 and notches 34 and 35, provide a locking means to prevent the subsequent, undesired removal of the spout portion during shipment or use of the container or bottle 4. In addition, the flexible band spout seal 64 engage an upper edge 14 of the neck 8 to prevent the leakage of container contents. Once the spout structure 20 is secured to the container or bottle 4, the cap structure 22 can be threaded upon the spout structure 20 so that the threads 49 of the vertical upper wall 47 of an interior portion 45 of the spout structure 20 engage the external threads 42 of the cap structure 22. When the cap structure 22 is tightly threaded onto the spout structure 20, the sealing rib 46 is placed in a contact relationship with the vertical upper wall 47 of an interior portion 45 of the spout structure 20 to prevent the leakage of container contents. The configuration of the present cap and spout closure 2 allows the cap structure 22 and the spout structure 20 to be pre-assembled at a remote location and subsequently threaded upon the container in one piece.

In operation, when the container or bottle 4 is inverted to pour the contents therefrom, the contents may easily flow through open channel 50, which provides fluid communication with the interior of the container and out the spout 30. In one embodiment, the cap structure 22 can be used as a measuring cup. If the cap structure 22 is used as a measuring cup, the external threads 40 of the surface 42 remain relatively free of container contents. Accordingly, the user will benefit because the configuration of the cap and spout closure 2 helps to eliminate wasteful and messy spillage.

The features of the present cap and spout closure 2, particularly the spout 30 and the drainage formation 54 as described herein, provide additional advantages. The arrangement of the spout 30 in relation to the drainage formation 54 and the mouth opening 6 of the container or bottle 4 increases the user's ability to control and direct the flow of the contents when the user inverts or angles the container or bottle 4 to utilize the product. Additionally, because of the location of the drainage formation 54 with respect to the lower floor 52 and the body of the spout 30, the quantity and speed of the flow of the contents is more consistent.

Yet another advantage of the present cap and spout closure 2 is the novel locking and orientating mechanism provided by lugs 16 and 17 and corresponding notches 34 and 35, which are configured and arranged so that the spout 30 is properly aligned on, and locked onto, the container or bottle 4. Typically, a spout 30 is properly oriented when it is directed away from the handle 18 of the container or bottle 4. However, defects, such as a deformation of the threading on either the container neck 8, the skirt 27, or the spout structure 20, can cause the spout 30 to be misaligned when fully assembled onto the container or bottle 4. The user may then attempt to manually adjust for the misalignment, by inverting or angling the container or bottle 4 in ways that will cause wasteful and messy spillage of the contents. The user may also attempt to realign the spout 30 onto the container or bottle 4 by unthreading or loosening the spout structure 20 until the spout 30 does align properly. This may result in the leakage of the contents or even substantial amounts of spillage and loss of the contents if the spout structure 20 eventually becomes unsecured from the container or bottle 4. An advantage of the present is provided by the fact that if the spout structure 20 is not properly orientated the lugs 16 and 17 and corresponding notches 34 and 35, respectfully, will not properly align and "snap" into place. This improper alignment occurs when the spout structure 20 is improperly secured onto the neck 8 of the container or bottle 4. As such, when the lugs 16 and 17 properly engage the notches 34 and 35, respectfully, and "snap" into place, the manufacturer or user can be sure that the spout is properly aligned and locked into place on the container or bottle 4.

While a particular embodiment of the dispenser closure of the invention has been shown and described, it will be appreciated by those skilled in the art that changes and modifications may be made thereto without departing from the invention in its broader aspects and as set forth in the following claims.

What is claimed is:

1. A dispensing package for a liquid product comprising:

a container having a mouth opening formed by a neck with threads on an exterior surface of said neck, said neck further containing at least one locking lug; and a spout structure, said spout structure containing a lower portion which is dimensioned to be inserted into said mouth opening of said container, a central body portion comprising a radial top edge, a depending skirt, and a spout for dispensing said liquid, wherein said skirt contains threads on an interior surface thereof, said threads on the interior surface of said skirt configured to threadably engage said threads on the exterior surface of said container neck, said spout structure further comprising at least one notch which engages said at least one locking lug, and at least one gripping rib, said at least one notch having a first edge and a second edge, and said at least one gripping rib is adjacent to said first edge of said at least one notch, wherein said spout structure is assembled over said mouth opening of said container, and said at least one gripping rib and said corresponding first edge of said at least one notch form a broad surface, said broad surface being oriented at least substantially parallel to the longitudinal axis of said spout structure and configured for countering a force exerted by a corresponding locking lug in a direction at least substantially perpendicular to the longitudinal axis of said spout structure, whereby said broad surface prevents overtorquing of said spout structure during assembly of said spout structure to said container.

2. The dispensing package of claim 1, wherein said dispensing package further contains a cap structure, said cap structure comprising an upper section, a radially projecting cap shoulder, and a lower section containing threads on the exterior surface thereof, and wherein said spout structure contains threads on an inner surface of said central body portion, said threads on said inner surface of said central body portion configured to threadably engage said threads on the exterior surface of said lower section of said cap structure.

3. The dispensing package of claim 2, wherein said cap structure includes measuring marks.

4. The dispensing package of claim 2, wherein said cap structure further containing at least one radial sealing rib located on the underside of said radially projection cap shoulder and which provides a seal between said cap structure and said spout structure.

5. The dispensing package of claim 4, wherein said cap structure further includes a plurality of gripping ribs on said upper section.

6. The dispensing package of claim 1, wherein said depending skirt of said spout structure contains said at least one notch and said at least one gripping rib.

7. The dispensing package of claim 6, wherein said depending skirt contains two notches both having a first edge and a second edge and at least two gripping ribs, wherein said gripping ribs are aligned adjacent to said first edge of said notches.

8. The dispensing package of claim 6, wherein said second edge provides a surface which prevents said spout structure from being removed from said container once assembled.

9. The dispensing package of claim 1, containing a first and a second locking lug and a first and a second notch, wherein said first notch corresponds to said first locking lug and said second notch corresponds to said second locking lug.

10. The dispensing package of claim 9, wherein said first lug is smaller than said second lug.

11. The dispensing package of claim 10, wherein said first lug is from about 4 mm wide to about 8 mm wide and said second lug is from about 6 mm wide to about 10 mm wide.

12. The dispensing package of claim 1, wherein said at least one lug is dove-tail shaped.

13. The dispensing package of claim 1, wherein said at least one notch is dove-tail shaped.

14. The dispensing package of claim 1, wherein said spout structure further comprises a lower floor.

15. The dispensing package of claim 14, wherein said spout structure further comprises a drainage formation in said lower floor.

16. The dispensing package of claim 15, wherein said lower floor is sloped downward toward said drainage formation.

17. The dispensing package of claim 1, wherein said spout structure includes a flexible band spout seal located on the underside of said radial top edge and which provides a seal between said spout structure and said neck of said container.

18. The dispensing package of claim 1, wherein said container includes a handle and said spout is non-concentrically oriented within said spout structure so that said spout is directed away from said handle of said container.

19. The dispensing package of claim 1, wherein said spout is generally frusto-conical shaped and contains a vertical slit, which runs vertically along the body of said spout.

* * * * *